US010039309B2

(12) United States Patent
Carroll et al.

(10) Patent No.: US 10,039,309 B2
(45) **Date of Patent: *Aug. 7, 2018**

(54) POUCH MATERIAL FOR SMOKELESS TOBACCO AND TOBACCO SUBSTITUTE PRODUCTS

(71) Applicant: ALTRIA CLIENT SERVICES LLC, Richmond, VA (US)

(72) Inventors: Andrew Nathan Carroll, Chester, VA (US); Shannon Maxwell Black, Richmond, VA (US); Yan Helen Sun, Midlothian, VA (US); William J. Burke, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 61 days.

This patent is subject to a terminal disclaimer.

(21) Appl. No.: 14/213,383

(22) Filed: Mar. 14, 2014

(65) Prior Publication Data

US 2014/0261480 A1 Sep. 18, 2014

Related U.S. Application Data

(60) Provisional application No. 61/786,315, filed on Mar. 15, 2013.

(51) Int. Cl.
*A24B 13/00* (2006.01)
*A24B 15/28* (2006.01)
(Continued)

(52) U.S. Cl.
CPC ..... *A24B 13/00* (2013.01); *A24B 15/186* (2013.01); *A24B 15/283* (2013.01); *D04H 13/00* (2013.01)

(58) Field of Classification Search
CPC ..... A24B 15/00; A24B 15/283; A24B 13/00; A24B 15/186
See application file for complete search history.

(56) References Cited

U.S. PATENT DOCUMENTS 2,580,609 A 1/1952 Schur et al.
2,734,509 A 2/1956 Jurgensen, Jr.
(Continued)

FOREIGN PATENT DOCUMENTS

DE 10346649 5/2005
WO WO 05/046363 5/2005
(Continued)

OTHER PUBLICATIONS

International Preliminary Report on Patentability in International Application No. PCT/US2014/028242, dated Sep. 24, 2015, 10 pages.
(Continued)

*Primary Examiner* — Anthony Calandra
(74) *Attorney, Agent, or Firm* — Harness, Dickey & Pierce, P.L.C.

(57) ABSTRACT

A melt-blown fabric for pouching smokeless tobacco or a smokeless tobacco substitute can include melt-blown polymer fibers. The fabric can have a basis weight of less than 10 gsm and a tensile strength of at least 4 mJ in at least one predetermined direction. Method of making the fabric can include melt-blowing a polymeric material against a support surface and bonding the fibers or arranging them in a predetermined orientation. Pouched smokeless tobacco or tobacco substitute products including the fabrics provided herein can provide desirable flavor and tactile experience.

22 Claims, 8 Drawing Sheets

(51) Int. Cl.
*A24B 15/18* (2006.01)
*D04H 13/00* (2006.01)

(56) References Cited

U.S. PATENT DOCUMENTS

| | | | | |
|---|---|---|---|---|
| 3,621,088 | A | 11/1971 | Hatcher et al. | |
| 3,849,241 | A | 11/1974 | Butin et al. | |
| 4,084,627 | A | 4/1978 | Focke et al. | |
| 4,090,521 | A | 5/1978 | Elsner | |
| 4,380,570 | A | 4/1983 | Schwarz | |
| 4,516,590 | A | 5/1985 | Teng | |
| 4,526,733 | A | 7/1985 | Lau | |
| 4,528,993 | A | 7/1985 | Sensabaugh, Jr. et al. | |
| 4,660,577 | A | 4/1987 | Sensabaugh et al. | |
| 4,848,373 | A | 7/1989 | Lenkey | |
| 4,987,907 | A | 1/1991 | Townend | |
| 5,063,104 | A | 11/1991 | Robertson et al. | |
| 5,146,955 | A | 9/1992 | Steiner et al. | |
| 5,366,793 | A * | 11/1994 | Fitts, Jr. ..... | D04H 1/74 156/167 |
| 5,372,149 | A | 12/1994 | Roth et al. | |
| 5,476,616 | A | 12/1995 | Schwarz | |
| 5,528,993 | A | 6/1996 | Vincelli | |
| 5,645,790 | A | 7/1997 | Schwarz et al. | |
| 6,013,223 | A | 1/2000 | Schwarz | |
| 6,207,601 | B1 | 3/2001 | Maurer et al. | |
| 6,455,030 | B2 | 9/2002 | Saito et al. | |
| 6,716,498 | B2 | 4/2004 | Curro et al. | |
| 7,156,937 | B2 | 1/2007 | Provost et al. | |
| 7,465,366 | B2 | 12/2008 | Provost et al. | |
| 7,547,469 | B2 | 6/2009 | Provost et al. | |
| 7,562,426 | B2 | 7/2009 | Barker et al. | |
| 7,666,261 | B2 | 2/2010 | Bailey et al. | |
| 7,718,556 | B2 | 5/2010 | Matsuda et al. | |
| 7,810,507 | B2 | 10/2010 | Dube et al. | |
| 2004/0038022 | A1 | 2/2004 | Maugans et al. | |
| 2004/0118421 | A1 | 6/2004 | Hodin et al. | |
| 2004/0118422 | A1 | 6/2004 | Lundin et al. | |
| 2004/0209540 | A1 | 10/2004 | Schwarz | |
| 2005/0056956 | A1 | 3/2005 | Zhao et al. | |
| 2005/0178398 | A1 | 8/2005 | Breslin et al. | |
| 2005/0196580 | A1 | 9/2005 | Provost et al. | |
| 2005/0196583 | A1 | 9/2005 | Provost et al. | |
| 2005/0217092 | A1 | 10/2005 | Barker et al. | |
| 2005/0244521 | A1 | 11/2005 | Strickland et al. | |
| 2006/0191548 | A1 | 8/2006 | Strickland et al. | |
| 2006/0264130 | A1 | 11/2006 | Karles et al. | |
| 2007/0261707 | A1 | 11/2007 | Winterson et al. | |
| 2008/0209586 | A1 | 8/2008 | Nielsen et al. | |
| 2008/0302682 | A1 | 12/2008 | Wngstrom et al. | |
| 2008/0305297 | A1 | 12/2008 | Barker et al. | |
| 2008/0308115 | A1 | 12/2008 | Zimmermann | |
| 2009/0133703 | A1 | 5/2009 | Strickland et al. | |
| 2009/0203280 | A9 | 8/2009 | Provost et al. | |
| 2009/0256277 | A1 | 10/2009 | Brown et al. | |
| 2009/0258099 | A1 | 10/2009 | Brown et al. | |
| 2009/0258562 | A1 | 10/2009 | Brown et al. | |
| 2010/0018539 | A1 | 1/2010 | Brinkley et al. | |
| 2010/0018882 | A1 | 1/2010 | St. Charles | |
| 2010/0170522 | A1 | 7/2010 | Sun et al. | |
| 2010/0242978 | A1 | 9/2010 | Fuisz | |
| 2010/0300465 | A1 | 12/2010 | Zimmermann | |
| 2011/0036364 | A1 | 2/2011 | Pienemann et al. | |
| 2011/0083688 | A1 | 4/2011 | Mishra et al. | |
| 2011/0220130 | A1 | 9/2011 | Mua et al. | |
| 2012/0024301 | A1 | 2/2012 | Carroll et al. | |
| 2012/0031414 | A1 | 2/2012 | Atchley et al. | |
| 2012/0031416 | A1 | 2/2012 | Atchley et al. | |
| 2012/0103353 | A1 | 5/2012 | Sebastian et al. | |
| 2013/0192392 | A1 | 8/2013 | Hollingsworth | |

FOREIGN PATENT DOCUMENTS

| | | |
|---|---|---|
| WO | WO 05/115180 | 12/2005 |
| WO | WO 09/048522 | 4/2009 |
| WO | WO 2010/087921 | 8/2010 |
| WO | WO 2011/117751 | 9/2011 |

OTHER PUBLICATIONS

International Search Report and Written Opinion in International Application No. PCT/US2014/028242, dated Jul. 15, 2014, 12 pages.

Tso, Chapter 1 in Tobacco, Production, Chemistry and Technology, 1999, Davis & Nielsen, eds., Blackwell Publishing, Oxford.

Rydholm, Pulping Processes, Interscience Publishers, 1967, 51-52.

European Office action in European Application No. 14716185.5, dated Apr. 20, 2017, 6 pages.

* cited by examiner

POUCH MATERIAL FOR SMOKELESS TOBACCO AND TOBACCO SUBSTITUTE PRODUCTS

CROSS REFERENCE TO RELATED APPLICATIONS

This application claims the benefit of priority under 35 U.S.C. § 119(e) to U.S. Application No. 61/786,315 filed Mar. 15, 2013. The prior application is incorporated herein by reference in its entirety.

WORKING ENVIRONMENT

This disclosure generally relates to a pouch material for smokeless tobacco or tobacco substitute products, methods of making pouch material, methods of pouching smokeless tobacco products, and smokeless tobacco products including the pouch material provided herein.

Smokeless tobacco is tobacco that is placed in the mouth and not combusted. There are various types of smokeless tobacco including: chewing tobacco, moist smokeless tobacco, snus, and dry snuff. Chewing tobacco is coarsely divided tobacco leaf that is typically packaged in a large pouch-like package and used in a plug or twist. Moist smokeless tobacco is a moist, more finely divided tobacco that is provided in loose form or in pouch form and is typically packaged in round cans and used as a pinch or in a pouch placed between an adult tobacco consumer's cheek and gum. Snus is a heat treated smokeless tobacco. Dry snuff is finely ground tobacco that is placed in the mouth or used nasally.

Smokeless Tobacco can be pouched in a fabric using a pouching machine. In some cases, a method for pouching smokeless tobacco includes flavoring the smokeless tobacco, pouching the flavored smokeless tobacco into a paper or fabric, and then packaging the pouches for delivery to consumers. A conventional pouching machine may form a supply of pouching material around tube, seal the edges of the pouching material to form a tube of pouching material, form a cross-seal to form a bottom of the pouch, deliver an amount of smokeless tobacco through the tube and into the bottom-sealed pouch, move the bottom-sealed pouch off the tube, and form a second cross-seal above the smokeless tobacco to close the pouch. The second-cross-seal can also be used as the bottom seal for a subsequent pouch as the process continues. Individual pouches can be cut at the cross-seals.

SUMMARY

Pouched smokeless tobacco products provided herein retain the smokeless tobacco material contained within the pouch, but provide an adult tobacco consumer with desirable flavor and tactile experience. In some cases, a pouched smokeless tobacco product provided herein includes a pouch material having a basis weight of between 10 grams per square meter (gsm) and 30 gsm. In some cases, a pouched smokeless tobacco product provided herein includes a pouch material having a basis weight of less than 10 gsm.

The smokeless tobacco can be a dry or moist smokeless tobacco. In some cases, the smokeless tobacco is moist smokeless tobacco having has an oven volatile content of about 30% by weight to about 61% by weight. In other embodiments, the smokeless tobacco is a dry snuff having an oven volatile content of between 2% and 15%. In some cases, the pouched tobacco product has an overall oven volatile content of about 4% by weight to about 61% by weight. In some cases, the smokeless tobacco can include an orally-disintegrable smokeless-tobacco composition, such as those described in US 2005/0244521 or US 2006/0191548 (which are hereby incorporated by reference). In some cases, the smokeless tobacco includes flavorants and/or other additives. Further, some systems include a container that retains a plurality of pouched smokeless tobacco products.

Methods of preparing a pouch fabric and for preparing the pouched smokeless tobacco product are also provided. Polymeric material (e.g., polypropylene) can be melt-blown or centrifugally force spun against a support surface and a resulting fabric collected. In some cases, the polymeric fibers in the fabric are oriented in a predetermined direction to provide a predetermined tensile strength in at least one direction. In some cases, the polymeric fibers are bonded at intersection points to provide a predetermined tensile strength in at least one direction. In some cases, a surfactant is sprayed onto the polymeric material as the polymer strands exit the melt-blowing device, centrifugal force spinning device, or downstream of the fabric forming process. The surfactant can provide a hydrophilic surface. The surfactant can also quench the polymeric fibers. A fabrics provided herein can then be used in a pouching machine, where an elongated supply of the fabric is formed into a fabric tube, overlapping sides of the fabric tube are sealed to form a side-sealed tube; a first cross-seal is formed across the side-sealed tube to form a bottom seal of a pouch, a predetermined amount of smokeless tobacco (or a tobacco substitute) is delivered into the bottom-sealed pouch, and a second cross-seal is formed above the delivered smokeless tobacco (or the delivered tobacco substitute). The second-cross-seal can also be used as the bottom seal for a subsequent pouch as the process continues. Individual pouches can be cut at the cross-seals. The fabrics provided herein can also be used in an alternative pouching process where tobacco is disposed on a fabric, a layer of a second fabric is disposed over the deposits of tobacco, and the composite structure sealed and cut around each deposit of tobacco to form a pouched product.

In some cases, a system includes a container including a lid and a base that defines an interior space. A plurality of pouched smokeless tobacco products can be disposed in the interior space of the container. The plurality of pouched smokeless tobacco products can each have a substantially similar shape and/or volume.

The polymeric fibers can be polymers safe for oral use. Suitable polymers can include but are not limited to polypropylene, low density polyethylene, polyethylene terephthalate, polyurethane, polyvinyl acetate, polyvinyl alcohol, styrene, ethyl vinyl acetate, rayon, silk, cotton, polyester, cellulosic materials such as hydroxypropyl cellulose and combinations thereof. In some cases, the polymeric fibers can include pigmented or dyed polymers. In some cases, reconstituted cellulosic fibers (e.g., derived from tobacco plant tissue) can be used.

A method of using the smokeless tobacco product is also described. The method includes opening a container containing at least one pouched smokeless tobacco product, removing a pouched smokeless tobacco product, and placing the removed pouched smokeless tobacco product in an adult tobacco consumer's mouth.

The products and methods described herein can also be applied to other orally consumable plant materials in addition to smokeless tobacco. For example, some non-tobacco or "herbal" compositions have also been developed as an alternative to smokeless tobacco compositions. Non-tobacco products may include a number of different primary ingredients, including but not limited to, tea leaves, red clover, coconut flakes, mint leaves, citrus fiber, bamboo fiber, ginseng, apple, corn silk, grape leaf, basil leaf, and other cellulosic materials. In some cases, such a non-tobacco smokeless product can further include tobacco extracts, which can result in a non-tobacco smokeless product providing a desirable mouth feel and flavor profile. In some cases, the tobacco extracts can be extracted from a cured and/or fermented tobacco by mixing the cured and/or fermented tobacco with water (or other solvents) and removing the non-soluble tobacco material. In some cases, the tobacco extracts can include nicotine. In some cases, a pouched non-tobacco product has an overall oven volatiles content of at least 10 weight percent. In some cases, a pouched non-tobacco product has an overall oven volatiles content of at least 40 weight percent.

Unless otherwise defined, all technical and scientific terms used herein have the same meaning as commonly understood by one of ordinary skill in the art to which the methods and compositions of matter belong. Although methods and materials similar or equivalent to those described herein can be used in the practice or testing of the methods and compositions of matter, suitable methods and materials are described below. In addition, the materials, methods, and examples are illustrative only and not intended to be limiting. All publications, patent applications, patents, and other references mentioned herein are incorporated by reference in their entirety.

DESCRIPTION OF DRAWINGS

Like reference symbols in the various drawings indicate like elements.

DETAILED DESCRIPTION

Figure 1A:
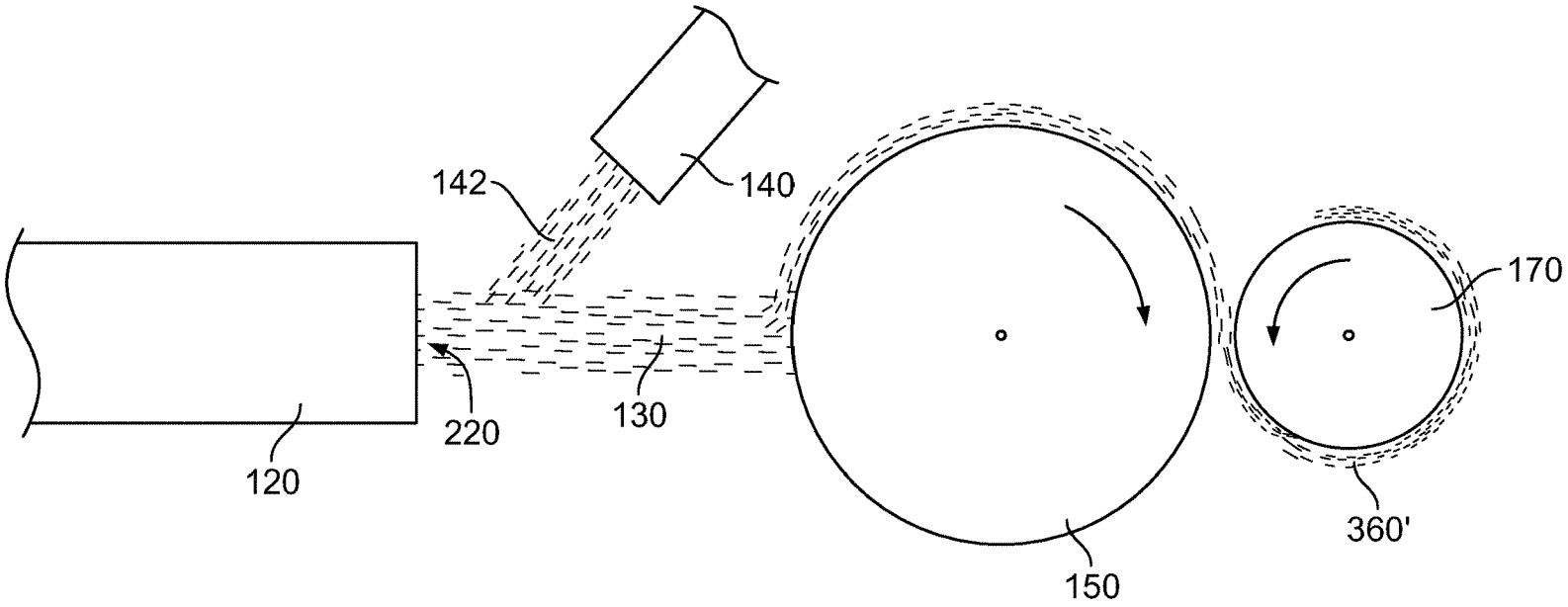
FIG. 1A is a perspective view of a system for melt-blowing polymeric fibers to create a fabric.

This disclosure provides a fabric for pouching smokeless tobacco and/or tobacco substitutes, a method for forming a pouching fabric provided herein, smokeless tobacco products including a pouching fabric provided herein, and non-tobacco pouched products including a pouching fabric provided herein. In some cases, the fabrics provided herein can be used in a conventional pouching machine, yet provide a smooth texture, immediate flavor/juice release, and a malleable smokeless tobacco product, such as that discussed below in reference to FIG. 4. In some cases, the fabrics provided herein can be used in an alternative pouching operation, as discussed below in regards to FIG. 5. In some cases, the fabric has a basis weight of less than 10 grams per square meter (gsm). In some cases, the fabric has a tensile integrity of at least 4 mJ in at least one predetermined orientation. In some cases, the fabric has oriented polymeric fibers in at least one predetermined orientation. In some cases, the polymeric fibers are bonded together at intersection points. In some cases, the polymeric fibers are contacted with a surfactant and/or water to provide a hydrophilic surface and/or to quench the polymeric fibers. In some cases, the polymeric fibers have a diameter of less than 100 microns, less than 50 microns, less than 10 microns, less than 5 microns, less than 1 micron, less than 0.5 microns, less than 0.1 microns, or less than 0.05 microns. In some cases, the polymeric fibers can be melt-blown polymeric fibers having a diameter of between 0.5 microns and 100 microns. In some case, the polymeric fibers can be centrifugal force spun fibers having a diameter of between 0.01 microns and 1 micron. The disclosure is based, in part, on the surprising discovery that the pouched smokeless tobacco products using the fabrics provided herein provide a unique tactile and flavor experience to an adult tobacco consumer. In particular, the polymeric strands can provide a smoother mouth texture and improved access to the smokeless tobacco as compared to a traditional pouching material, but still retain the smokeless tobacco. Furthermore, the pouching fabric provided herein can be more elastic and can permit an adult tobacco consumer to chew the pouched smokeless tobacco product and mold the pouched product into a desired shape (e.g., to comfortably conform the pouched smokeless tobacco product between the cheek and gum). For example, the melt-blown material can be an elastomer (e.g., a polymeric polyurethane such as DESMOPAN DP 9370A available from Bayer) thus forming a pouched smokeless tobacco product that can better tolerate being "worked" (e.g., chewed or squeezed) in the mouth. As compared to a typical pouch paper, the fabrics provided herein can be softer, have a lower basis weight, and act as less of a selective membrane. The methods of forming pouched smokeless tobacco products including the fabrics provided herein are also described. In some cases, combinations of mouth-stable and mouth-dissolvable polymeric materials are combined to form the fabric to produce a pouched smokeless tobacco product that becomes looser when placed in an adult tobacco consumer's mouth, yet remains generally cohesive. Polymeric fibers in the fabric can also be a composite of multiple materials, which may include both mouth-stable and mouth-dissolvable materials.

Method of Making Fabric

The fabric can be made by melt-blowing polymeric fibers, centrifugal force spinning polymeric fibers, or a combination thereof. The fibers can form a non-woven fabric. Melt-blowing and centrifugal force spinning methods are discussed below.

Melt-Blowing Processes

Figure 1B:
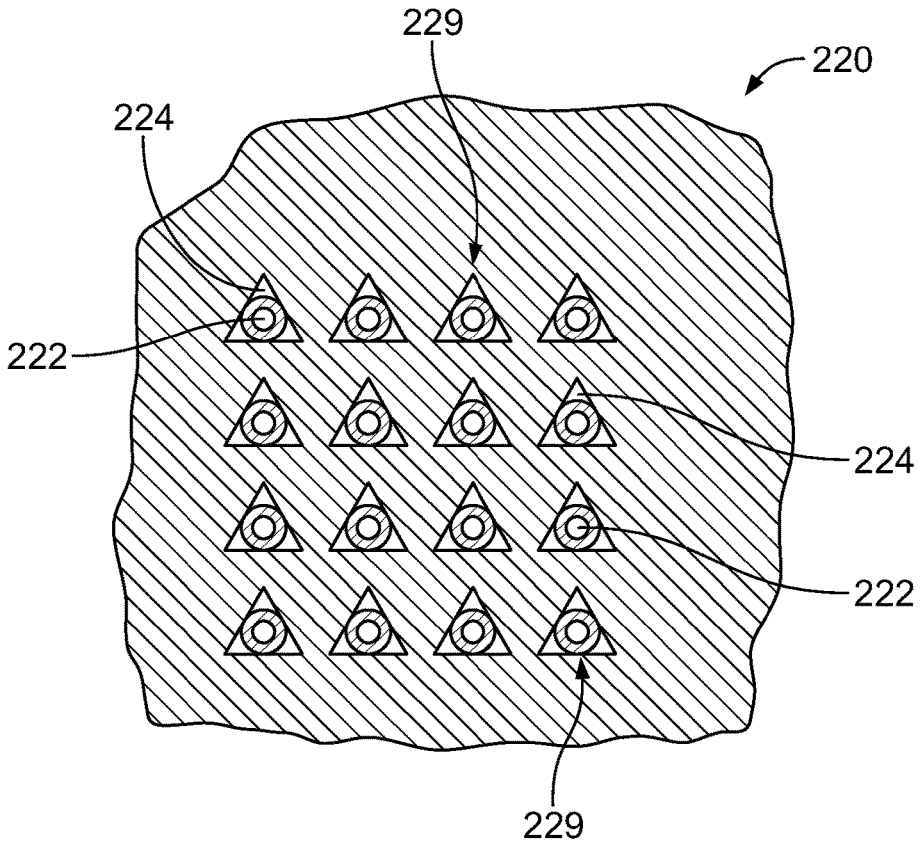
FIG. 1B depicts an exemplary arrangement of polymer orifices and air orifices for a melt-blowing apparatus.

Referring to FIGS. 1A and 1B, a melt-blown fabric can be formed by depositing a plurality of melt-blow polymeric fibers 130 onto a support surface (e.g., rotating vacuum drum 150) and collecting the melt-blown fabric 360' (e.g., on a pickup roll 170).

In some cases, the melt-blown polymeric fibers 130 have diameters of less than 100 microns (or less than 50 microns, or less than 30 microns, or less than 10 microns, or less than 5 microns, or less than 1 micron, or less than 0.5 microns. In some cases, the melt-blown polymeric fibers 130 have a diameter of between 0.5 and 5 microns.

Melt-blown polymeric fibers 130 can be produced using a melt-blowing device 120. Melt-blowing is an extrusion process where molten polymeric resins are extruded through an extrusion die and gas is introduced to draw the filaments to produce polymeric fibers. The gas can be heated air blown at high velocity through orifices that surround each spinnerets. In some cases, layers of hot air are blown through slots between rows of spinnerets—the strands of polymeric material are attenuated by being trapped between two layers of air. Other methods of delivering the attenuating gas (e.g., heated air) are possible. The polymeric fibers can be deposited onto a support surface (e.g., moving conveyor or carrier). For example, the melt-blown polymeric fibers 130 are deposited onto a rotating vacuum drum 150 in FIG. 1.

FIG. 1B depicts an exemplary melt-blowing device 220. Other melt-blowing devices are described in U.S. Pat. Nos. 4,380,570; 5,476,616; 5,645,790; and 6,013,223 and in U.S. Patent Applications US 2004/0209540; US 2005/0056956; US 2009/0256277; US 2009/0258099; and US 2009/0258562, which are hereby incorporated by reference. The melt-blowing device 220 can include a polymer extruder that pushes molten polymer at low melt viscosities through a plurality of polymer orifices 222. The melt-blowing device 220 includes one or more heating devices that heat the polymer as it travels through the melt-blowing device 220 to ensure that the polymer remains above its melting point and at a desired melt-blowing temperature. As the molten polymer material exits the polymer orifice 222, the polymer material is accelerated to near sonic velocity by gas being blown in parallel flow through one or more air orifices 224. The air orifices 224 can be adjacent to the polymer orifices 222. The air orifices 224 may surround each polymer orifice 222. Each combination of a polymer orifice 222 with surrounding air orifices 224 is called a spinneret 229. For example, the melt-blowing device 220 can have between 10 and 500 spinnerets 229 per square inch. The polymer orifices 222 and the gas velocity through gas orifices 224 can be combined to form fibers of 100 microns or less. In some cases, the spinnerets each have a polymer orifice diameter of 30 microns or less. In some cases, the melt-blown polymeric fibers 130 have diameters of between 0.5 microns and 5 microns. The factors that affect fiber diameter include throughput, melt temperature, air temperature, air pressure, and distance from the drum. In some cases, the spinnerets 229 each have a polymer orifice diameter of less than 1800 microns. In some cases, the spinnerets 229 each have a polymer orifice diameter of at least 75 microns. The average polymer orifice diameter can range from 75 microns to 1800 microns. In particular embodiments, the average polymer orifice diameter can be between 150 microns and 400 microns. In certain cases, polymer orifice diameters of about 180 microns, about 230 microns, about 280 microns, or about 380 microns are used.

Referring back to FIG. 1A, rotating vacuum drum 150 is adapted to produce a vacuum in the area behind the spinnerets. The vacuum can pull the melt-blown polymeric fibers towards the rotating vacuum drum 150 and may assist in fiber bonding. In some cases, a moving conveyor (optionally passing over a vacuum chamber) can be used instead of the rotating vacuum drum 150. In some cases, no vacuum is used during the melt-blowing process, which may result in a more random distribution of fibers and less fiber-to-fiber bonding during an initial melt-blowing process. The melt-blown fabric system can also include one or more spray nozzles 140 for directing a quenching fluid, surfactant, or other treatment solution 142 towards the stream of fibers as they exit the melt-blowing device 120. The possible treatment fluids are discussed below in greater detail.

Centrifugal Force Spinning Processes

Figure 2A:
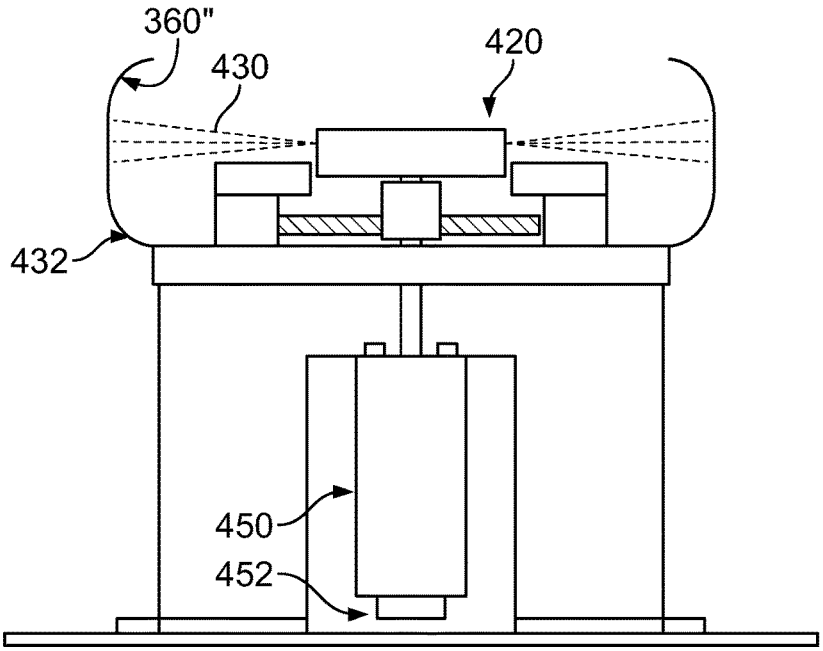
FIGS. 2A-2E depicts an exemplary system for centrifugal force spinning fibers to create a fabric.
Figure 2B:
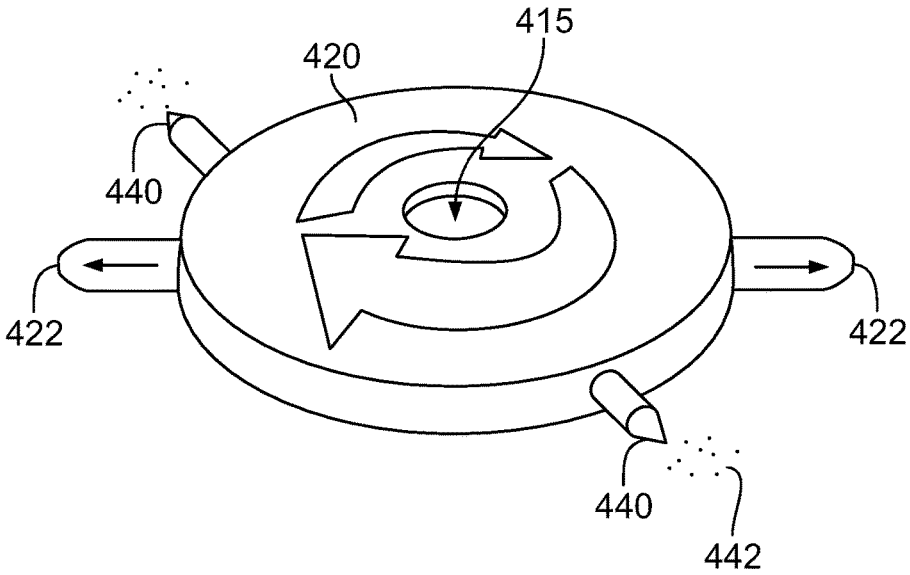
Figure 2C:
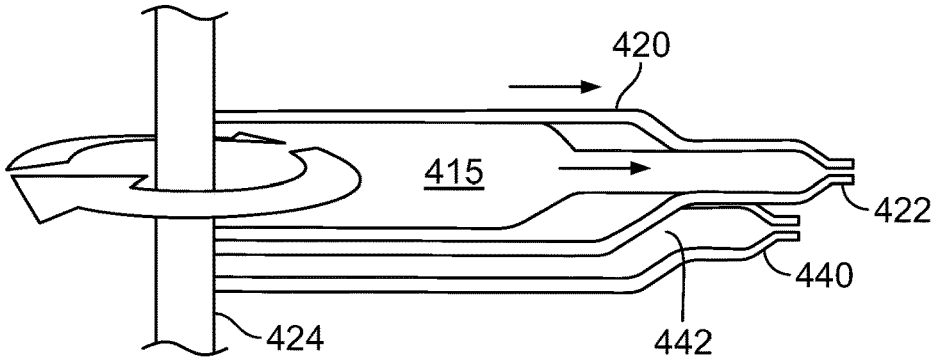
Figure 2D:
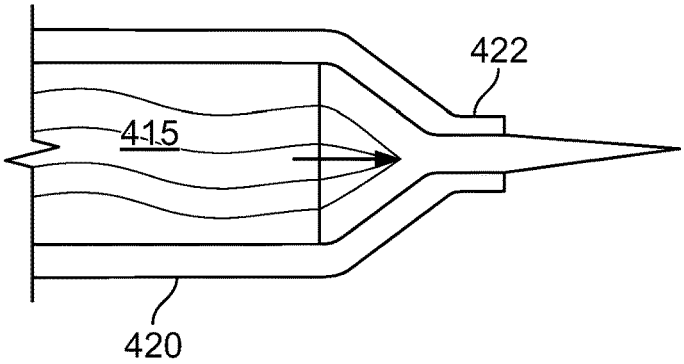
Figure 2E:
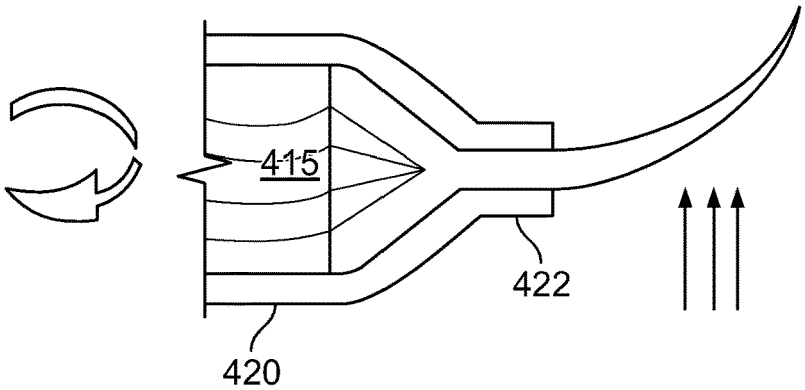

Centrifugal force spinning is a process where centrifugal force is used to create and orient polymeric fibers. FIGS. 2A-2E depict an exemplary centrifugal force spinning apparatus. As shown, a spinneret 420 holds polymeric material 415 and is rotated at high speeds with a motor 450 to produce polymeric fibers 430 that are deposited onto a fiber collector 432 to create a centrifugal force spun fabric 360". FIG. 2B depicts a close-up of the spinneret 420 showing two orifices 422. Any number of orifices 422 can be used. The centrifugal force spinning apparatus can also include one or more spray nozzles 440 for directing a quenching fluid, surfactant, or other treatment solution 442 towards the stream of fibers as they exit the spinneret orifices 422. FIG. 2C depicts how the spinneret 420 can be equipped to also provide a treatment fluid 440 and a spray nozzle 442. The possible treatment fluids are discussed below in greater detail.

The fiber collector 432 can be a continuous drum or a series of spaced collection fingers. As the spinneret 420 rotates, the polymeric material (in a liquid state) is pushed to the orifices 422 lining the outer wall of the spinneret 420. As the polymeric material enters the orifice chamber, molecules disentangle and then align directionally. Centrifugal and hydrostatic forces combine to initiate a liquid material jet. The external aerodynamic environment combined with the inertial force of continued rotation further applies shear forces and promote cooling and/or solvent evaporation to further stretch the fiber. The inertia force can stretch molecular chains into the nanoscale and the air turbulence can apply a shear force.

Figure 3:
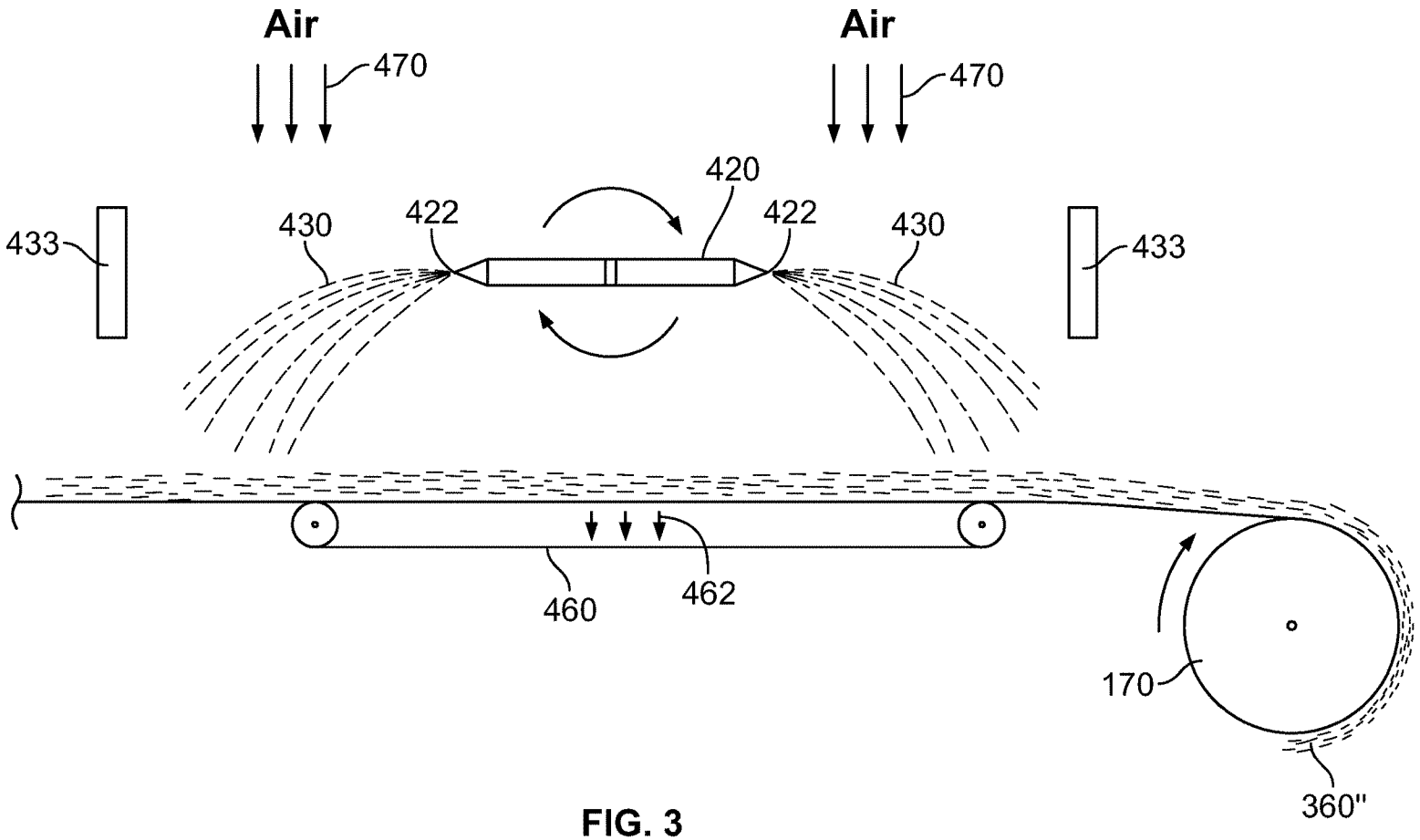
FIG. 3 depicts an alternative arrangement for forming a fabric by centrifugally force spinning fibers.

FIG. 3 depicts an alternative arrangement for creating a centrifugal force spun fabric 360". As shown, a spinneret 420 is positioned above a conveyor 460. A carrier 436 can be used to collect a centrifugal force spun fabric 360". As shown, centrifugal force spun fibers exit spinneret orifices 422 approximately perpendicular to the carrier 436. The fibers 430 encounter a stream of air 470 (and optionally treatment fluids as discussed below) which direct the centrifugal force spun fibers towards the carrier 436. A conveyor 460 supporting the carrier 436 can draw a vacuum 462 to facilitate the laying of a centrifugally force spun fabric 360". In some cases, the carrier 436 is a porous carrier that facilitates the drawing of a vacuum through the carrier 436. Collection fingers 433 can be positioned around the spinneret 420 to collect any stray fibers. The centrifugal force spun fabric can be collected on a pickup roll 170.

Polymeric Fibers and Treatments

The fibers of the fabric provided herein can include the full array of extrudable polymers, such as polypropylene, polyethylene, PVC, viscose, rayon, polyester, and PLA. In some cases, the fibers are mouth-stable fibers. The mouth-stable fibers can have low extractables, have FDA food contact approval, and/or be manufactured by suppliers who are GMP approved. Highly desirable are materials that are easy to process and relatively easy to approve for oral use (e.g. quality, low extractables, has FDA food contact approval, suppliers are GMP approved). In some cases, the mouth-stable structural fibers are elastomers. Elastomers can provide webs with improved elongation and toughness. Suitable elastomers include VISTAMAX (ExxonMobil) and MD-6717 (Kraton). In some cases, elastomers can be combined with polyolefins at ratios ranging from 1:9 to 9:1. For example, elastomers (such as VISTAMAX or MD-6717) can be combined with polypropylene.

Mouth-dissolvable fibers could be made from hydroxypropyl cellulose (HPC), methyl hydroxypropyl cellulose (HPMC), polyvinyl alcohol (PVOH), PVP, polyethylene oxide (PEO), starch and others. These fibers could contain flavors, sweeteners, milled tobacco and other functional ingredients. The fibers could be formed by extrusion or by solvent processes. In some cases, mouth dissolvable fibers can be combined with mouth-stable fibers to produce a pouching fabric 360' or 360" provided herein.

As discussed above, both melt-blown fibers and centrifugally force spun fibers can be treated with a treatment fluid 142 or 442 with a spray nozzle 140 or 440 as the fibers exit the melt-blowing device 120 or the centrifugally force spinning spinneret 420. In some cases, the fibers can be treated downstream as part of a fabric 360' or 360".

Water vapor can be used to cool the polymeric material. For example, water vapor can be directed into the stream of molten strands of polymeric material to "quench" the polymeric strands and form the fibers. For example, as depicted in FIG. 1A, a mist 142 can be aimed towards the spinnerets 229 of the melt-blowing device 120. As depicted in FIG. 2B, a centrifugally force spinning spinneret can also provide a mist 442 which can contact force-spun fibers as they exit orifices 422. In some cases, a mist can be provide with air stream 470 to quench the fibers 430 formed in the apparatus depicted in FIG. 3. A fine mist of water vapor can quickly cool the strands below the polymer's glass transition temperature. In some cases, quenched fibers can have improved softness and fiber/web tensile strength.

A surfactant treatment can also be applied to the fibers of the fabric 360' or 360". In some cases, a surfactant is applied to the polymer fibers as they exit the spinnerets 229 of the melt-blowing device 120 or the orifices 422 of a centrifugally force spinning spinneret 420. In some cases, surfactant can be applied as a mist 142 or 442 (either with or without water) as shown in FIG. 1A or FIG. 2B. In some cases, surfactant can be applied as a stream or a bath. In some cases, the surfactant applied as a mist 142 or 442 can quench the polymer fibers. In some cases, a mixture of water and surfactant can be atomized an applied as mist 142 or 442. Sweeteners and/or flavorants can also be atomized and applied to the polymer fibers in mist 142 or 442.

Quenching the polymer can modify the crystallinity of the polymer material to improve tensile strength. The surfactant can improve the hydraulic permittivity of the fabric 360' or 360" to improve moisture and flavor release. The hydraulic permittivity is the rate of fluid transfer through a substrate. Table 1 compares fabrics produced with and without surfactant treatment and water quenching. As shown in Table 1, melt-blown Sample 1 (produced without water quenching or a surfactant treatment) had a tensile integrity of 5.73 mJ and a permittivity of 8 seconds. Quenching with water (Sample 3) improved the tensile integrity to 7.09 mJ. Applying surfactant mixtures at different percentages also resulted in improved tensile integrity values (Samples 5-7). Added surfactant in amounts of 0.4% or greater (Samples 2, 6, and 7) reduced the permittivity to 6 seconds.

TABLE 1

Analytical Results Comparing Non-Treated & Surfactant Treated Melt Blown Material

| | Analysis Results | | | | | | |
|---|---|---|---|---|---|---|---|
| | 3962 PP Polymer | 3962 PP Polymer | 3962 PP Polymer | 3962 PP Polymer | 3962 PP Polymer | 3962 PP Polymer | 3962 PP Polymer |
| | Sample # | | | | | | |
| | 1 5-2-MB-001 PP3962 Standard MB Material | 2 5-2-MB-001 PP3963 LAB ADDED SURFACTANT | 3 5-2-MB-002 PP3962, Water Quenching, 3 g/m3 | 4 5-2-MB-002 PP3962, Water Quenching, 3 g/m4 LAB ADDED SURFACTANT | 5 5-2-MB-003 PP3962, Surfactant 0.2%, 3 g/m2 | 6 5-2-MB-004 PP3962, Surfactant 0.4%, 3 g/m2 | 7 5-2-MB-005 PP3962, Surfactant 0.6%, 3 g/m2 |
| Tensile Integrity (mJ) | 5.73 | | 7.09 | | 6.94 | 6.10 | 6.12 |
| stdev | 0.89 | | 0.75 | | 0.85 | 1.19 | 0.67 |
| Permittivity (relative liquid flow through rate, s) | 8 | 6 | 7 | 6 | 8 | 6 | 6 |
| stdev | 0.5 | 0.3 | 0.4 | 0.5 | 0.0 | 0.0 | 0.0 |
| Basis Weight (G/m2) | 3.0 | 3.0 | 3.0 | 3.0 | 3.0 | 3.0 | 3.0 |

The tensile integrity of the fabric 360' or 360" can also be improved in a machine direction by provided fiber alignment along that machine direction. For example, the fibers produced by centrifugal force spinning that are substantially aligned. As will be discussed below, improved tensile integrity in a machine direction can allow the fabric 360' or 360" to be pulled through a pouching machine to slit, form, and cut pouched products while still having a basis weight of less than 40 gsm, less than 10 gsm, less than 5 gsm, less than 3 gsm, or less than 2 gsm. In some cases, a fabric 360' or 360" having a basis weight of about 3 gsm can have a tensile integrity in a machine direction of at least 6 mJ, at least 7 mJ, or at least 8 mJ. Tensile integrity of the fabric 360' or 360" can also be improved by applying tension to the fabric 360' or 360" when the fabric is in a heated tunnel or zone oven. By heating the polymer fibers to the glass transition temperature while under tension, the polymer fibers can be oriented in the direction of tension.

The heating of the polymeric material to a temperature above its glass transition temperature can be accomplished by using electrically heated surfaces, ultrasonic bonding, infrared energy, radio frequency energy, and microwave energy. Stitch bonding, point bonding, and quilting are methods of applying patterns to nonwoven fabrics. These are forms of thermal bonding typically achieved with ultrasonic bonding processes although other energy sources and related equipment can be used to create particular patterns of bonding within the network of fibers. Stitch bonding, point bonding, and quilting can all be used to conform polymeric fibers to at least portions of a surface topography of at least some of the fibrous structures of the tobacco.

Bonding between the structural fibers can also be accomplished by incorporating a low melting temperature polymer into the network of structural fibers. The low melting temperature polymer could be introduced into the network in the form of fibers, beads, or random shapes. The low melting temperature polymer fibers, beads, or random shapes can be dispersed within the network of structural fibers. In some cases, the low melting temperature polymer has a melting point of between about 40° C. and 150° C. By heating the composite of the structural fibers, the smokeless tobacco, and the low melting temperature polymeric material to a temperature between the melting points of the two different materials (thus also above the glass transition temperature of the low melting temperature polymer), the low melting temperature polymeric material can be selectively melted and thus bond to surrounding fibers and also conform to at least portions of a surface topography of at least some of the fibrous structures of the tobacco. In some cases, the structural polymeric fibers are bicomponent or multicomponent fibers made of different materials.

Chemically bonding can also be used to further secure polymer fibers in the fabric 360' or 360". For example, adhesive materials in the form of beads or small random shapes, solvents, and/or solutions can be intermingled with the network of polymeric fibers and activated with heat and/or pressure to bond the network. In some cases, heat is used to both activate a chemical bonding agent and to bring the polymeric material above or below its glass transition temperature to conform the polymeric material to the fibrous structures of the tobacco. In some cases, silicone or polyvinyl acetate is used as a chemical adhesive. In some cases, sodium alginate is added to the network and then a calcium salt added to make the alginate insoluble within the network and thus bond surrounding fibers. Chemical bonding can be used with any other technique described herein.

The hydraulic permittivity of the fabric can also be increased by compounding the polymeric material with a filler prior to melt-blowing the polymeric material. In some embodiments, a colorant can be used as the filler. For example, a brown colorant can be added to a feed hopper of the extruder along with a polymer material (e.g., polypropylene) prior to melt blowing the polymer into the fibers. In addition to improving the hydraulic permittivity, the colorant can improve the aesthetic appeal of the pouched product 390. For example, a brown colorant can make a pouched moist-smokeless tobacco product appear moist. Table 2 below compares a melt-blown polypropylene polymer fabrics produced with and without brown colorant.

TABLE 2

| | | Analysis Results | |
|---|---|---|---|
| | | 3962 PP Polymer w/o Color | 3962 PP Polymer w/ Brown Color |
| | | Sample # | |
| Replicates | | 1 5-2-MB-001 PP3962, 3 g/m2 | 2 5-2-MB-006 PP3962, Techmer 8%, 3.1 g/m2 |
| 6 | Tensile Integrity (mJ) | 5.73 | 7.19 |
| | stdev | 0.89 | 1.23 |
| 15 | Permittivity (relative liquid flow through rate, s) | 8 | 3 |
| | stdev | 0.5 | 0.4 |
| | Basis Weight (g/m2) | 3.0 | 3.1 |

As shown, the polypropylene having the brown colorant (Techmer) had an increased tensile integrity and a permittivity. The colorant and the polymer can be compounded and pelletized prior to melt-blowing the polymer to ensure a consistent ratio of colorant to polymer.

Suitable polymeric materials include one or more of the following polymer materials: acetals, acrylics such as polymethylmethacrylate and polyacrylonitrile, alkyds, polymer alloys, allyls such as diallyl phthalate and diallyl isophthalate, amines such as urea, formaldehyde, and melamine formaldehyde, epoxy, cellulosics such as cellulose acetate, cellulose triacetate, cellulose nitrate, ethyl cellulose, cellulose acetate, propionate, cellulose acetate butyrate, hydroxypropyl cellulose, methyl hydroxypropyl cellulose (CMC), HPMC, carboxymethyl cellulose, cellophane and rayon, chlorinated polyether, coumarone-indene, epoxy, polybutenes, fluorocarbons such as PTFE, FEP, PFA, PCTFE, ECTFE, ETFE, PVDF, and PVF, furan, hydrocarbon resins, nitrile resins, polyaryl ether, polyaryl sulfone, phenol-aralkyl, phenolic, polyamide (nylon), poly (amide-imide), polyaryl ether, polycarbonate, polyesters such as aromatic polyesters, thermoplastic polyester, PBT, PTMT, (polyethylene terephthalate) PET and unsaturated polyesters such as SMC and BMC, thermoplastic polyimide, polymethyl pentene, polyolefins such as LDPE, LLDPE, HDPE, and UHMWPE, polypropylene, ionomers such as PD and poly allomers, polyphenylene oxide, polyphenylene sulfide, polyurethanes (such as DESMOPAN DP 9370A available from Bayer), poly p-xylylene, silicones such as silicone fluids and elastomers, rigid silicones, styrenes such as PS, ADS, SAN, styrene butadiene latricies, and styrene based polymers, suflones such as polysulfone, polyether sulfone and polyphenyl sulfones, polymeric elastomers, and vinyls such as PVC, polyvinyl acetate, polyvinylidene chloride, polyvinyl alcohol, polyvinyl butyrate, polyvinyl formal, propylene-vinyl chloride copolymer, ethylvinyl acetate, and polyvinyl carbazole, polyvinyl pyrrolidone, and polyethylene oxide, and ethylene vinyl alcohol.

The polymeric material can include multiple materials. In some cases, fibers of a first polymeric material are interspersed or layered with fibers of a second polymeric material. For example, a lower melting polymer can function as a binder which may be a separate fiber interspersed with higher melting structural polymer fibers. In some cases, structural fibers can include multiple components made of different materials. For example, a lower melting sheath can surround a higher melting core, which can help with the conforming and/or bonding processes. The components of a multi-component fiber can also be extruded in a side-by-side configuration. For example, different polymeric materials can be co-extruded and drawn in a melt-blowing or force spun to form the multi-component structural fibers.

In some cases, the polymeric material includes one mouth-stable material and one mouth-dissolvable material such that the smokeless tobacco product will loosen but remain cohesive as the mouth-dissolvable material dissolves away. In some cases, a network of structural polymeric fibers includes mouth-dissolvable polymeric fibers and mouth-stable polymeric fibers. As used herein, "mouth-stable" means that the material remains cohesive when placed in an adult tobacco consumer's mouth for 1 hour. As used herein, "mouth-dissolvable" means that the material breaks down within 1 hour after being exposed to saliva and other mouth fluids when placed in an adult tobacco consumer's mouth. Mouth-dissolvable materials include hydroxypropyl cellulose (HPC), methyl hydroxypropyl cellulose (HPMC), polyvinyl alcohol (PVOH), PVP, polyethylene oxide (PEO), starch and others. Mouth-dissolvable materials could be combined with flavors, sweeteners, milled tobacco and other functional ingredients. In other embodiments, multi-component fibers include a mouth-stable material and a mouth-dissolvable material.

In some cases, the polymeric material includes reconstituted cellulosic fibers. Reconstituted cellulosic fibers can be created from various woods and annual plants by physically dissolving the wood or plant material in a suitable solvent, such as methylmorpholine oxide (MNNO) monohydrate. The concentration of cellulose in the solution can be between 6 weight and 15 weight percent. The solution can then be spun (e.g., melt-blown or centrifugally force spun) at a temperature of between 40° C. and 150° C. to create reconstituted cellulosic fibers. In some cases, the reconstituted cellulosic fibers are made using tobacco material (e.g., tobacco stems). Reconstituted tobacco cellulosic fibers can then be intermingled with smokeless tobacco having natural cellulosic fibers to create a pouched tobacco product having tobacco-derived structural fibers. The reconstituting process changes the composition of the tobacco and removes soluble tobacco components.

The polymeric material can also be combined with milled tobacco prior to contacting the tobacco with the smokeless tobacco. For example, milled tobacco could be combined into a polymeric structural fiber such that the polymeric material at least partially encapsulates the milled tobacco. For example, milled tobacco could be added to a molten polymer (e.g., polypropylene) in amounts of up to about 80% and extruded in a melt-blowing or spun bond process. The milled tobacco can provide a unique texture while the polymeric material remains mouth-stable and cohesive.

The amount of polymeric material used in the pouched tobacco product 390 or 590 depends on the desired flavor profile and desired mouth feel. In some cases, the pouched tobacco product 390 or 590 includes between 0.1 and 10 weight percent polymeric material, which can increase the likelihood that the pouched tobacco product 390 or 590 maintains its integrity during packaging and transport.

Tobacco

The fabric 360' or 360" can be used to pouch tobacco. In some cases, the tobacco can be smokeless tobacco.

Smokeless tobacco is tobacco suitable for use in an orally used tobacco product. By "smokeless tobacco" it is meant a part, e.g., leaves, and stems, of a member of the genus *Nicotiana* that has been processed. Exemplary species of tobacco include *N. rustica, N. tabacum, N. tomentosiformis*, and *N. sylvestris*. Suitable tobaccos include fermented and unfermented tobaccos. In addition to fermentation, the tobacco can also be processed using other techniques. For example, tobacco can be processed by heat treatment (e.g., cooking, toasting), flavoring, enzyme treatment, expansion and/or curing. Both fermented and non-fermented tobaccos can be processed using these techniques. In other embodiments, the tobacco can be unprocessed tobacco. Specific examples of suitable processed tobaccos include, dark air-cured, dark fire-cured, burley, flue cured, and cigar filler or wrapper, as well as the products from the whole leaf stemming operation. In some cases, smokeless tobacco includes up to 70% dark tobacco on a fresh weight basis.

Tobacco can be conditioned by heating, sweating and/or pasteurizing steps as described in U.S. Publication Nos. 2004/0118422 or 2005/0178398. In addition to modifying the aroma of the leaf, fermentation can change the color, texture, and other sensorial attributes (taste) of a leaf. Also during the fermentation process, evolution gases can be produced, oxygen can be taken up, the pH can change, and the amount of water retained can change. See, for example, U.S. Publication No. 2005/0178398 and Tso (1999, Chapter 1 in Tobacco, Production, Chemistry and Technology, Davis & Nielsen, eds., Blackwell Publishing, Oxford). Cured, or cured and fermented tobacco can be further processed (e.g., cut, expanded, blended, milled or comminuted) prior to incorporation into the smokeless tobacco product. The tobacco, in some cases, is long cut fermented cured moist tobacco having an oven volatiles content of between 30 and 61 weight percent prior to mixing with the polymeric material and optionally flavorants and other additives.

The tobacco can, in some cases, be prepared from plants having less than 20 μg of DVT per $cm^2$ of green leaf tissue. For example, the tobacco particles can be selected from the tobaccos described in U.S. Patent Publication No. 2008/0209586, which is hereby incorporated by reference. Tobacco compositions containing tobacco from such low-DVT varieties exhibits improved flavor characteristics in sensory panel evaluations when compared to tobacco or tobacco compositions that do not have reduced levels of DVTs.

Green leaf tobacco can be cured using conventional means, e.g., flue-cured, barn-cured, fire-cured, air-cured or sun-cured. See, for example, Tso (1999, Chapter 1 in Tobacco, Production, Chemistry and Technology, Davis & Nielsen, eds., Blackwell Publishing, Oxford) for a description of different types of curing methods. Cured tobacco is usually aged in a wooden drum (i.e., a hogshead) or cardboard cartons in compressed conditions for several years (e.g., two to five years), at a moisture content ranging from 10% to about 25%. See, U.S. Pat. Nos. 4,516,590 and 5,372,149. Cured and aged tobacco then can be further processed. Further processing includes conditioning the tobacco under vacuum with or without the introduction of steam at various temperatures, pasteurization, and fermentation. Cure, aged, and fermented smokeless tobacco can be further processed (e.g., cut, shredded, expanded, or blended). See, for example, U.S. Pat. Nos. 4,528,993; 4,660,577; and 4,987,907.

The smokeless tobacco can be processed to a desired size. For example, long cut smokeless tobacco typically is cut or shredded into widths of about 10 cuts/inch up to about 110 cuts/inch and lengths of about 0.1 inches up to about 1 inch. Double cut smokeless tobacco can have a range of particle sizes such that about 70% of the double cut smokeless tobacco falls between the mesh sizes of −20 mesh and 80 mesh. Other lengths and size distributions are also contemplated.

The smokeless tobacco can have a total oven volatiles content of about 10% by weight or greater; about 20% by weight or greater; about 40% by weight or greater; about 15% by weight to about 25% by weight; about 20% by weight to about 30% by weight; about 30% by weight to about 50% by weight; about 45% by weight to about 65% by weight; or about 50% by weight to about 60% by weight. Those of skill in the art will appreciate that "moist" smokeless tobacco typically refers to tobacco that has an oven volatiles content of between about 30% by weight and about 61% by weight (e.g., about 45% by weight to about 55% by weight, or about 50% by weight). As used herein, "oven volatiles" are determined by calculating the percentage of weight loss for a sample after drying the sample in a pre-warmed forced draft oven at 110° C. for 3.25 hours. The pouched tobacco product can have a different overall oven volatiles content than the oven volatiles content of the smokeless tobacco used to make the pouched tobacco product. The processing steps described herein can reduce or increase the oven volatiles content. The overall oven volatiles content of the pouched tobacco product is discussed below.

The pouched tobacco product 390 or 590 can include between 15 weight percent and 85 weight percent smokeless tobacco on a dry weight basis. The amount of smokeless tobacco in a pouched tobacco product 390 or 590 on a dry weight basis is calculated after drying the pouched tobacco product in a pre-warmed forced draft oven at 110° C. for 3.25 hours. The remaining non-volatile material is then separated into tobacco material and polymeric material. The percent smokeless tobacco in the pouched tobacco product is calculated as the weight smokeless tobacco divided by the total weight of the non-volatile materials. In some cases, the pouched tobacco product includes between 20 and 60 weight percent tobacco on a dry weight basis. In some cases, the pouched tobacco product includes at least 28 weight percent tobacco on a dry weight basis.

In some cases, a plant material other than tobacco is used as a tobacco substitute in the pouched product 390 or 590. The tobacco substitute can be an herbal composition. Herbs and other edible plants can be categorized generally as culinary herbs (e.g., thyme, lavender, rosemary, coriander, dill, mint, peppermint) and medicinal herbs (e.g., Dahlias, Cinchona, Foxglove, Meadowsweet, Echinacea, Elderberry, Willow bark). In some cases, the tobacco is replaced with a mixture of non-tobacco plant material. Such non-tobacco compositions may have a number of different primary ingredients, including but not limited to, tea leaves, red clover, coconut flakes, mint leaves, ginseng, apple, corn silk, grape leaf, and basil leaf. The plant material typically has a total oven volatiles content of about 10% by weight or greater; e.g., about 20% by weight or greater; about 40% by weight or greater; about 15% by weight to about 25% by weight; about 20% by weight to about 30% by weight; about 30% by weight to about 50% by weight; about 45% by weight to about 65% by weight; or about 50% by weight to about 60% by weight.

Flavorants and Additives

Flavors and other additives can be included in the compositions and arrangements described herein and can be added to the pouched tobacco product 390 or 590 at any point in the process. For example, any of the initial components, including the polymeric material, can be provided in a flavored form. In some cases, flavorants and/or other additives are included in the smokeless tobacco. In some cases, flavorants and/or other additives are absorbed into to the pouched tobacco product 390 or 590 after pouching. In some cases, flavorants and/or other additives are mixed with the polymeric material (e.g., with structural fibers) prior to melt-blowing the fibers and/or as the fibers exit the spinnerets.

Suitable flavorants include wintergreen, cherry and berry type flavorants, various liqueurs and liquors such as Drambuie, bourbon, scotch, whiskey, spearmint, peppermint, lavender, cinnamon, cardamom, apium graveolents, clove, cascarilla, nutmeg, sandalwood, bergamot, geranium, honey essence, rose oil, vanilla, lemon oil, orange oil, Japanese mint, cassia, caraway, cognac, jasmine, chamomile, menthol, ilangilang, sage, fennel, piment, ginger, anise, coriander, coffee, liquorish, and mint oils from a species of the genus Mentha. Mint oils useful in particular embodiments of the pouched tobacco products 390 or 590 include spearmint and peppermint.

Flavorants can also be included in the form of flavor beads, which can be dispersed within the pouched tobacco product (e.g., in a nonwoven network of polymeric structural fibers). For example, the pouched tobacco product could include the beads described in U.S. Patent Application Publication 2010/0170522, which is hereby incorporated by reference.

In some cases, the amount of flavorants in the pouched tobacco product 390 or 590 is limited to less than 30 weight percent in sum. In some cases, the amount of flavorants in the pouched tobacco product 390 or 590 can be limited to be less than 5 weight percent in sum. For example, certain flavorants can be included in the pouched tobacco product in amounts of about 3 weight percent.

Other optional additives can include but are not limited to fillers (e.g., starch, dicalcium phosphate, lactose, sorbitol, mannitol, and microcrystalline cellulose), soluble fiber (e.g., Fibersol from Matsushita), calcium carbonate, dicalcium phosphate, calcium sulfate, and clays), sodium chloride, lubricants (e.g., lecithin, stearic acid, hydrogenated vegetable oil, mineral oil, polyethylene glycol 4000-6000 (PEG), sodium lauryl sulfate (SLS), glyceryl palmitostearate, sodium benzoate, sodium stearyl fumarate, talc, and stearates (e.g., Mg or K), and waxes (e.g., glycerol monostearate, propylene glycol monostearate, and acetylated monoglycerides)), plasticizers (e.g., glycerine, propylene glycol, polyethylene glycol, sorbitol, mannitol, triacetin, and 1,3 butane diol), stabilizers (e.g., ascorbic acid and monosterol citrate, BHT, or BHA), artificial sweeteners (e.g., sucralose, saccharin, and aspartame), disintegrating agents (e.g., starch, sodium starch glycolate, cross caramellose, cross linked PVP), pH stabilizers, or other compounds (e.g., vegetable oils, surfactants, and preservatives). Some compounds display functional attributes that fall into more than one of these categories. For example, propylene glycol can act as both a plasticizer and a lubricant and sorbitol can act as both a filler and a plasticizer.

Oven volatiles, such as water, may also be added to the pouched tobacco product 390 or 590 to bring the oven volatiles content of the pouched tobacco product into a desired range. In some cases, flavorants and other additives are included in a hydrating liquid.

Oven Volatiles

The pouched tobacco product 390 or 590 can have a total oven volatiles content of between 10 and 61 weight percent. In some cases, the total oven volatiles content is at least 40 weight percent. The oven volatiles include water and other volatile compounds, which can be a part of the tobacco, the polymeric material, the flavorants, and/or other additives. As used herein, the "oven volatiles" are determined by calculating the percentage of weight loss for a sample after drying the sample in a pre-warmed forced draft oven at 110° C. for 3.25 hours. Some of the processes may reduce the oven volatiles content (e.g., heating the composite or contacting the smokeless tobacco with a heated polymeric material), but the processes can be controlled to have an overall oven volatiles content in a desired range. For example, water and/or other volatiles can be added back to the pouched tobacco product to bring the oven volatiles content into a desired range. In some cases, the oven volatiles content of the composite pouched tobacco product 390 is between 50 and 61 weight percent. For example, the oven volatiles content of smokeless tobacco used in the various processed described herein can be about 57 weight percent. In other embodiments, the oven volatiles content can be between 10 and 30 weight percent.

Method of Pouching

Figure 4:
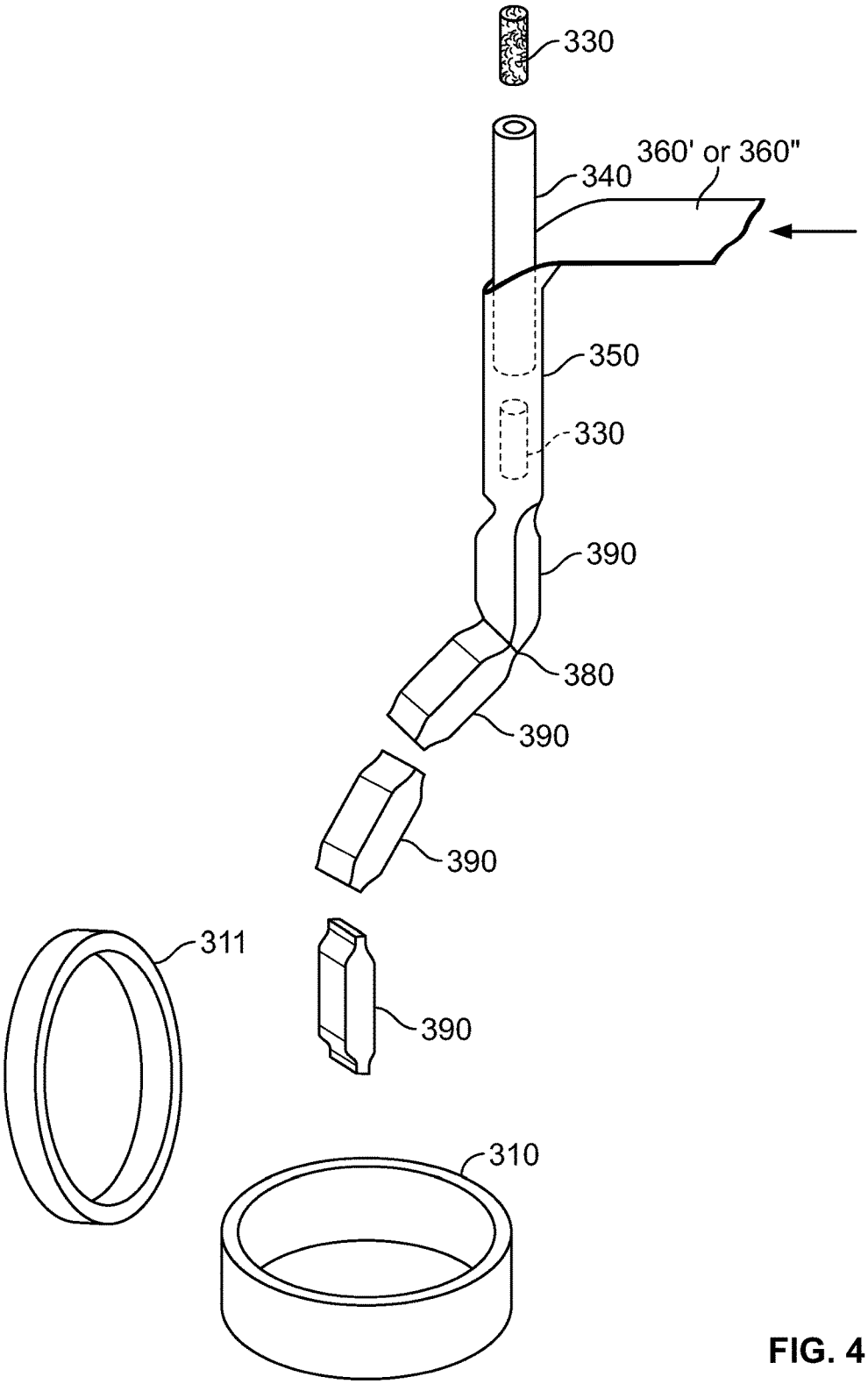
FIG. 4 is a schematic drawing of system for pouching smokeless tobacco or a tobacco substitute.

Tobacco or a tobacco substitute can be pouched in a fabric provided herein as shown in FIG. 4. As shown, fabric 360' or 360" is formed around tube 340 to form a tube of pouching fabric 350. The overlapping edge portions of the fabric 360' or 360" can be heat sealed together against tube 340 or between pinch rollers to form the fabric tube 350. A seal 380 can be made along the fabric tube 350 to form a bottom of a pouch. Tobacco or a tobacco substitute 330 can be deposited into the partially formed pouch 390 through tube 340. The fabric can continue to be advanced and a second seal 380 can be made to fully seal the pouch 390 and provide a bottom seal for a subsequent pouch 390. The pouches 390 can be separated along the seal 380 and deposited into a bottom portion 310 of a container. The lid 311 of the container can be connected to the bottom portion 310 to enclose the pouches 390.

The bottom container 310 and lid 311 can releasably mate at a connection rim so as to maintain freshness and other product qualities of pouched tobacco products 390 contained therein. Such qualities may relate to, without limitation, texture, flavor, color, aroma, mouth feel, taste, ease of use, and combinations thereof. In particular, the container may have a generally cylindrical shape and include a base and a cylindrical side wall that at least partially defines the interior space. In some cases, the container is moisture-tight. Certain containers can be air-tight. The connection rim formed on the container can provide a snap-fit engagement with the lid. It will be understood from the description herein that, in addition to the container, many other packaging options are available to hold one or more of the pouched tobacco products 390.

Figure 5:
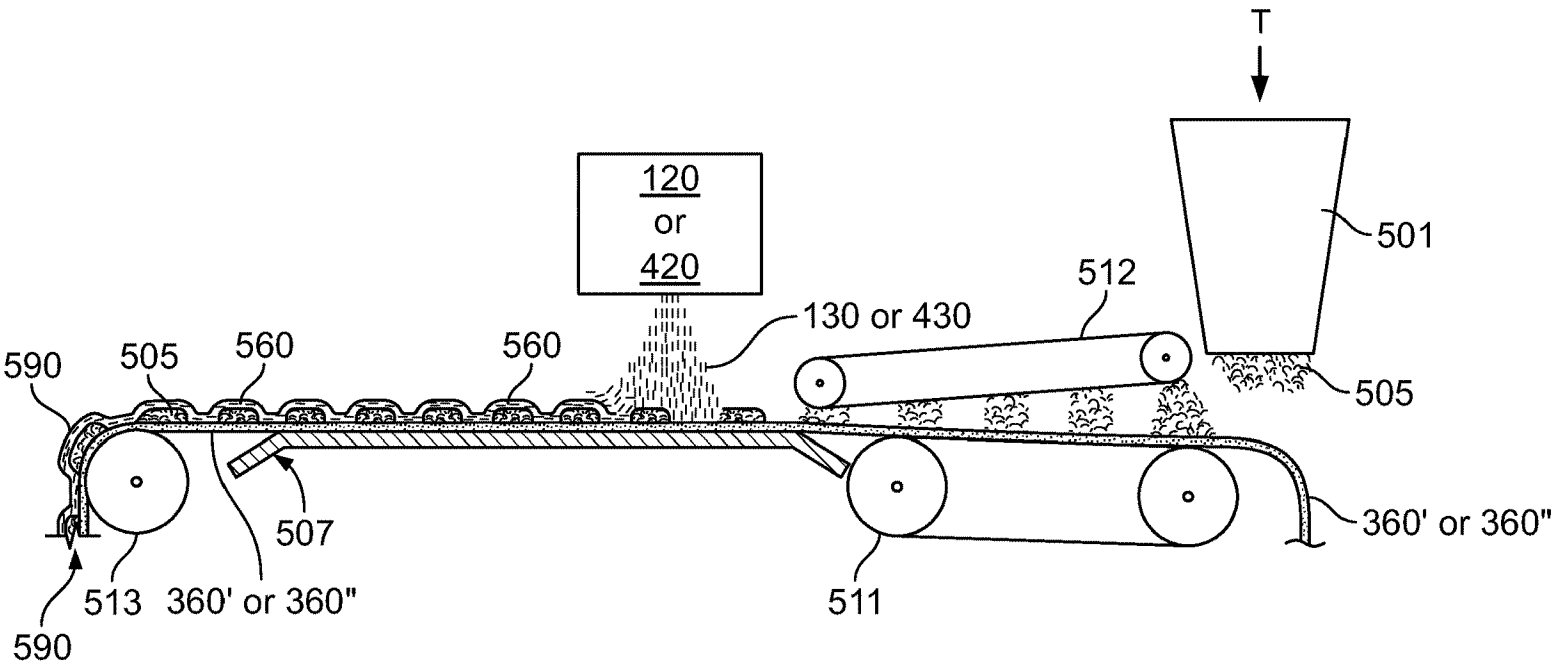
FIG. 5 is a schematic drawing of an alternative arrangement for pouching smokeless tobacco or a tobacco substitute.
Figure 6A:
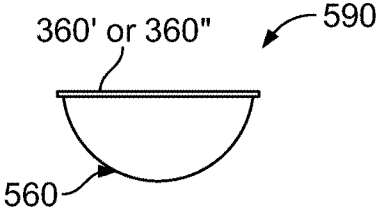
FIGS. 6A-6E are views of a pouched product.
Figure 6B:
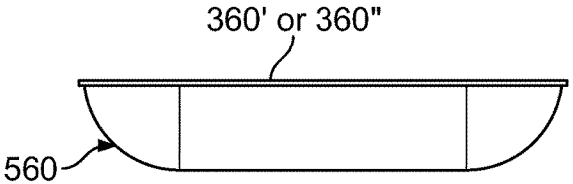
Figure 6C:
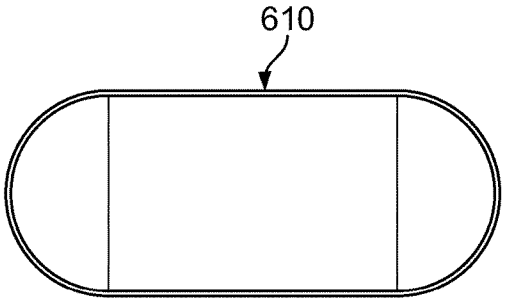
Figure 6D:
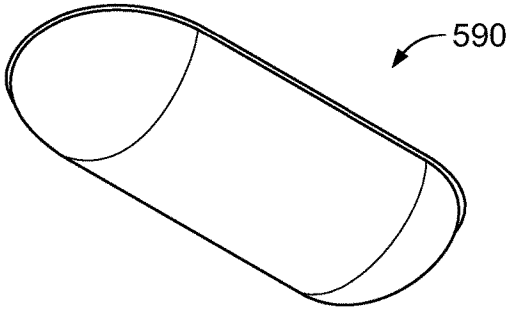
Figure 6E:
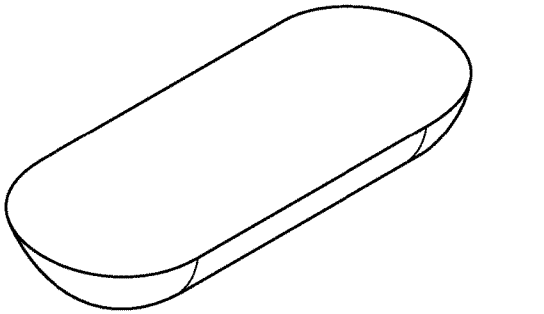

Tobacco or a tobacco substitute T can also be pouched in a fabric provided herein in a method such as that shown in FIG. 5. As shown in FIG. 5, discrete deposits of smokeless tobacco 505 or a tobacco substitute can be deposited on a fabric 360' or 360" and one or more additional layers of polymeric fibers 560 can be deposited thereon bonded to the fabric 360' or 360" around the periphery of each discrete deposit of smokeless tobacco. For example, discrete deposits of the smokeless tobacco 505 can be deposited onto fabric 360' or 360". In some cases, the discrete deposits includes a smokeless tobacco having an aspect ratio greater than 3 (e.g., long-cut smokeless tobacco). In some cases, the smokeless tobacco has a moisture content of at least 40 weight percent OV. In some cases, one or more conveyor parts 511 and/or 512 are shaped to size, compact, and/or position each discrete deposit. In some cases, the smokeless tobacco is deposited in a loose form. In some cases, loose deposits of smokeless tobacco can include a binder to help with the binding properties. For example, in some embodiments, conveyor 512 may include bumps, cavities, and/or ridges that correspond to predetermined discrete deposit sizes and shapes. Each discrete deposit can correspond approximately to an amount of smokeless tobacco generally found in a pouched smokeless tobacco product (e.g., between about 0.25 to 4.0 grams). For example, the smokeless tobacco product can include about 2.5 grams of smokeless tobacco. Melt-blown or centrifugally force spun polymeric fiber 130 or 430 can then be deposited over the fabric 360' or 360" and the discrete deposits 505 as a continuous layer 560. The polymeric fibers 130 or 430 can be bond with fabric 360' or 360" and conform to the surface topography of some of the tobacco's fibrous structures. In some cases, heat can be used to seal the edges around each deposit 505. The composite can then be die cut to separate the pouches 590. FIGS. 6A-6E depict various views of a pouched tobacco product 590 after being sealed and cut. As shown, the pouched tobacco product 590 can have a relatively flat surface and a curved surface.

Prophetic Example

A pouched tobacco product could be made by pouching of SKOAL Long Cut smokeless tobacco (Wintergreen flavored) having a moisture (i.e. oven volatiles) content of 57% with a fabric including polypropylene fibers formed with a melt-blowing apparatus. The polypropylene fibers can include 8% brown colorant (Techmer). As the fibers leave the melt-blowing apparatus, they can be sprayed with a mixture of water and surfactant to quench the fibers as they exit the spinnerets. The polypropylene fibers can have a diameter of between 0.5 and 5.0 microns. The fabric can have a basis weight of 3 gsm and a tensile strength of at least 7 mJ.

Other Embodiments

It is to be understood that, while the invention has been described herein in conjunction with a number of different aspects, the foregoing description of the various aspects is intended to illustrate and not limit the scope of the invention, which is defined by the scope of the appended claims. Other aspects, advantages, and modifications are within the scope of the following claims.

Disclosed are methods and compositions that can be used for, can be used in conjunction with, can be used in preparation for, or are products of the disclosed methods and compositions. These and other materials are disclosed herein, and it is understood that combinations, subsets, interactions, groups, etc. of these methods and compositions are disclosed. That is, while specific reference to each various individual and collective combinations and permutations of these compositions and methods may not be explicitly disclosed, each is specifically contemplated and described herein. For example, if a particular composition of matter or a particular method is disclosed and discussed and a number of compositions or methods are discussed, each and every combination and permutation of the compositions and the methods are specifically contemplated unless specifically indicated to the contrary. Likewise, any subset or combination of these is also specifically contemplated and disclosed

What is claimed is:

1. A smokeless tobacco product comprising:

a pouch comprising a fabric, the fabric comprising melt-blown or centrifugally-force-spun polymer fibers substantially aligned along a first direction, the fabric comprising a surfactant that provides a hydrophilic surface coating, the fabric comprising a colorant configured to reduce hydraulic permittivity of the polymer fibers; and smokeless tobacco within the pouch.

2. The smokeless tobacco product of claim 1, wherein the fabric has a basis weight of less than 5 gsm.

3. The smokeless tobacco product of claim 2, wherein the fabric has a basis weight of between 0.5 and 3 gsm.

4. The smokeless tobacco product of claim 1, wherein the melt-blown polymer fibers have diameters of less than 100 microns.

5. The smokeless tobacco product of claim 4, wherein the melt-blown polymer fibers have a diameter of less than 30 microns.

6. The smokeless tobacco product of claim 4, wherein the melt-blown polymer fibers have a diameter of between 0.5 and 5.0 microns.

7. The smokeless tobacco product of claim 1, wherein the melt-blown polymer fibers include at least two different materials.

8. The smokeless tobacco product of claim 1, wherein the at least two different polymeric materials are coextruded during a melt-blowing operation to form composite polymeric fibers of the at least two different polymeric materials.

9. The smokeless tobacco product of claim 8, wherein at least one of the polymeric materials is mouth-stable and at least one of the polymeric materials is mouth-dissolvable.

10. The smokeless tobacco product of one of claim 1, wherein the smokeless tobacco product has an overall oven volatiles content of about 4% by weight to about 61% by weight.

11. The smokeless tobacco product of claim 10, wherein the smokeless tobacco product has an overall oven volatiles content of about 30% by weight to about 61% by weight.

12. The smokeless tobacco product of claim 1, further comprising one or more flavorants.

13. The smokeless tobacco product of claim 1, wherein the smokeless tobacco product is adapted to remain substantially cohesive when placed in an adult tobacco consumer's mouth and exposed to saliva.

14. The smokeless tobacco product of claim 1, wherein the melt-blown polymer fibers comprise polypropylene.

15. The smokeless tobacco product of claim 1, further comprising a dissolvable film at least partially coating the pouch.

16. The smokeless tobacco product of claim 1, wherein the smokeless tobacco comprises cured tobacco.

17. The smokeless tobacco product of claim 16, wherein the smokeless tobacco comprises cured, aged, fermented tobacco.

18. The smokeless tobacco product of claim 16, wherein the smokeless tobacco comprises cured, aged, non-fermented tobacco.

19. The smokeless tobacco product of claim 1, wherein the pouch weighs less than 50 mg.

20. The smokeless tobacco product of claim 1, wherein the smokeless tobacco comprises dark tobacco.

21. The smokeless tobacco product of claim 1, wherein the smokeless tobacco has an average length of between 0.1 and 1.0 inches and an average width of 0.009 to 0.1 inches.

22. A packaged smokeless tobacco product comprising:

a container that defines a moisture-tight interior space; and at least one smokeless tobacco product according to claim 1 within the container.

* * * * *